United States Patent [19]

Stagemeyer et al.

[11] 4,139,470

[45] Feb. 13, 1979

[54] SYSTEM FOR SEPARATING, REMOVING AND RECOVERING CONTAMINANT MATERIALS FROM A BODY OF WATER

[75] Inventors: Merlin D. Stagemeyer, Northbrook, Ill.; Seth F. Allcorn, Columbia, Mo.

[73] Assignee: Oil Spill Recovery, Inc., Northbrook, Ill.

[21] Appl. No.: 779,675

[22] Filed: Mar. 21, 1977

[51] Int. Cl.[2] ..... E02B 15/04

[52] U.S. Cl. ..... 210/170; 210/242 S; 210/512 R; 210/DIG. 25

[58] Field of Search ..... 61/1 F; 114/39, 267, 114/292; 210/83, 242 S, 512 R, DIG. 25, 170

[56] References Cited

U.S. PATENT DOCUMENTS

| | | | |
|---|---|---|---|
| 3,495,561 | 2/1970 | Trapp | 114/267 |
| 3,616,772 | 11/1971 | Popkin | 114/267 |
| 3,630,376 | 12/1971 | Price | 210/242 S |
| 3,635,342 | 1/1972 | Mourlon et al. | 210/242 S X |
| 3,638,430 | 2/1972 | Smith | 61/1 F |
| 3,648,463 | 3/1972 | Ayers | 61/1 F |
| 3,688,506 | 9/1972 | Marcocchio | 61/1 F |
| 3,700,108 | 10/1972 | Richards | 210/242 S |
| 3,701,425 | 10/1972 | Laval, Jr. | 210/512 R X |
| 3,731,813 | 5/1973 | Tipton | 210/DIG. 25 |
| 3,757,953 | 9/1973 | Sky-Eagle, Jr. | 210/242 S |
| 3,779,385 | 12/1973 | Strohecker | 210/242 S X |
| 3,785,496 | 1/1974 | Smith, Jr. | 210/DIG. 25 |
| 3,789,988 | 2/1974 | Valibouse et al. | 210/242 S |
| 3,800,951 | 4/1974 | Mourlon et al. | 210/242 S |
| 3,860,519 | 1/1975 | Weatherford | 210/242 S |

*Primary Examiner*—Robert H. Spitzer
*Attorney, Agent, or Firm*—Fitch, Even, Tabin & Luedeka

[57] ABSTRACT

A system for removing and recovering contaminants from bodies of water utilizes a channeling device moving relative to the contaminated water to funnel it to a skimming apparatus. The skimming scoop directs the collected contaminant water mixture into cylindrical separator means, also moving relative to the contaminated body of water. Creation of a separation vortex within the separator cylinder separates the contaminant in an upward direction from the downwardly discharged water. At such time the contaminant is transported to storage facilities, free of the water upon which it floated for reclamation and/or reuse.

25 Claims, 21 Drawing Figures

SYSTEM FOR SEPARATING, REMOVING AND RECOVERING CONTAMINANT MATERIALS FROM A BODY OF WATER

BACKGROUND OF THE INVENTION

The present invention relates in general to pollution abatement apparatus and, in particular, to contaminant recovery systems for removing and/or recovering contaminant materials from the surface of a body of water.

Only recently has there been an overwhelming realization for the importance of protecting various elements of the earth's environment. In the area of water pollution, for example, society has only started to pay the price for years of careless, indiscriminate pollution of our oceans, rivers and lakes. Industrial wastes and refuse, public sanitation wastes, and mammoth oil spills are only some of the sources of pollution responsible for the virtual destruction of many of our bodies of water. One recent oil spill, for example, responsible for the dumping of millions of gallons of unrefined crude oil into the ocean, attested to the severity of our pollution problems in the form of marred beaches, wildlife destruction, and millions of dollars expended merely to trace the direction of the spill and determine its environmental impact. The overall damaging effects must be realized to include the virtual loss of extremely valuable and expensive resource material itself which could not and has not been recovered for reuse and/or reclamation.

It thus becomes apparent that there exists at present an overwhelming need for systems, apparatus, and the like which make possible the recovery of contaminant material from a myriad of bodies of water in order to prevent the destructive consequences now being encountered. These systems at the same time must be capable of recovering and reclaiming the often valuable resources causing the pollution itself.

Several relatively recent inventions have been directed to just these purposes. Some of these devices, for example, are directed primarily to the separating of oil and solids from water. While these are necessary elements for any attempt to recover the lost contaminant, for the most part, these inventions fail to solve the problem encountered with actually recovering the contaminant from the body of water before separation is attempted.

Other inventions have ranged from the utilization of flexible shields within a boat hull to act as a buffer in case of collision so as to protect an oil cargo; to vacuum inventions in which contaminant material is sucked into a vacuum hose suspended just below the surface of the water to fill a tank. With such a device the oil and water are sucked in together and, if given enough time, separate by gravity, at which time the water can be drained from the bottom of the tank and the oil reused.

In one invention, oil is removed from the surface of water by applying a mixture of wax and a volatile inflammable substance. The resulting mixture is ignited, the wax fuses into a solidified mass and is then picked up. Such an invention is embodied in U.S. Pat. No. 3,785,972. In U.S. Pat. No. 3,785,496, a carbohydrate fatty acid ester in powder, fibrous, or granular form, is applied to spilled oil on water. After picking the absorbent material back up, much of the oil is claimed to be recovered.

Several types of skimming devices have been utilized for the recovery and reclammation of contaminants such as oil. One type of oil skimming device, referred to as a drum type skimmer utilizes a rotating drum or cylinder covered with an oil absorbent material to absorb the oil from the oil and water mixture. The surfaces are generally not wetted by water but instead only by oil. The oil is squeezed or scraped off the surface of the drum by a knife blade or by rollers and then segregated from the water. It should be noted that the effectiveness of this type of skimmer is substantially small due to the substantial inefficiency utilized in skimming and withdrawing the oil from the saturated drum.

Another type of oil skimming device utilizes an oil absorbent surface on a continuous belt to absorb the oil from an oil and water mixture. In a manner equivalent to the drum type skimmer, this belt type skimmer carries the oil to the top of the belt mechanism where a blade or similar piece of equipment squeezes the oil from the belt before recycling. The belt is supported normally on two drums: one to submerge the belt in the oil and water mixture, and the other out of the mixture where the removal of the oil takes place. Besides encountering the inefficient removal problems discussed previously with the drum type oil skimmer, such a belt type oil skimming device is generally limited to calm waters or where oil films are of considerable thickness.

Another type of apparatus removes a surface layer of low density from a body of liquid of higher density. This Weir type of skimming device comprises a flexible pipe or pipes surrounded by a layer of buoyant material in an outer sheath so that the flexible pipes float on the surface of the body of liquid. A number of suction nozzles connected to the flexible pipes, a filter for separating the surface liquid from the liquid of the body and a method for discharging the separated water back into the main body of water are all incorporated into the apparatus. In operation, the pipeline is laid on the surface of the sea so that it surrounds the patch of oil which is to be removed. The suction nozzles dip into the surface layer and the contaminant and a certain amount of sea water are sucked into the piping and carried into a ship where it is forced to a filtering apparatus to separate the oil from the water.

The problems with existing contaminant recovery systems include their inability to accommodate all the variations that can occur with regards to (1) the type of contaminant being recovered, (2) the characteristics of the body of water from which the contaminant is being recovered, and (3) the temperatures of and reactions by the water and the contaminant to one another. For example, while some recovery devices work relatively well in calm waters, these devices have little, if any, effectiveness with turbulent or rolling seas which often complicate the recovery process. Further, all contaminants are not in the same material form. For example, three different types of petroleum contaminants, sweet, sour, and asphaltic, all provide different recovery problems for a skimming or recovery system. Asphaltic oil on the surface of substantially cold water, virtually hardens into an asphalt-like material which needs to be removed more like a solid than a liquid. Additionally, extremes in temperature of any body of water causes a contaminant located thereon to possess different and sometimes peculiar characteristics which cannot often be handled by the conventional skimming apparatus.

For the most part, the conventional skimming, vacuum, or other type of recovery devices require substantial machinery and investment, and are often cumbersome and difficult to deploy and control. Additives which break down the petroleum substance might offer a viable alternative to assist the environment but at the same time they destroy the resource that could be recovered. Various types of barrier restraints which merely surround the contaminant to keep it from spreading, again, protect the environment while doing little in the way of recovering a substantially valuable resource.

It is thus an object of the present invention to provide a system for effectively removing from the surface of a body of water petroleum and/or many other types of undesirable contaminants including vegetation or refuse, while at the same time recovering the contaminant in its original form for reuse or reprocessing.

It is further an object of the present invention to be flexible for use with many different types of contaminants in several types of bodies of water at varying temperatures.

Additionally, it is an object of the present invention to improve the recovery rate and efficiency with which the contaminant is recovered while at the same time being relatively easy to deploy and control.

Further, it is an object of the present invention to provide a system for effectively recovering the contaminant at a substantially reduced cost and with a minimum of manpower.

These and other objects of the invention will become apparent in light of the present specification.

SUMMARY OF THE INVENTION

The present invention comprises a system for removing and recovering contaminant material from the surface of a body of water. The system itself incorporates open-ended apron channeling means which are maintained afloat in the body of water by apron buoys. These channeling means are directed substantially around the massive contaminant material by system activation means. The apron channeling means are substantially impervious to the contaminant material and when moved about and into the mass of contaminant material, the channeling means channel or funnel such contaminant material to contaminant collection means attached at the furthermost end of the apron channeling means and as these apron channeling means converge toward the contaminant collection means, they appropriately funnel or channel the contaminant material floating on the surface of the body of water into the collection means. The collection means includes adjustable scoop means for skimming the contaminant material from the surface of the body of water as the contaminant material is directed into the collection means. Additionally, contaminant separator means are operably attached to the collection means for separating the contaminant material from the water. Material transport means operably attached to the contaminant separator means remove the separated contaminant material from the system to enable its recovery and reuse, as desired.

Movement of the system is accomplished through the above mentioned system activation means. Initiation of movement between the contaminated body of water relative to the contaminant removal system, enables the surrounding and funneling of the contaminated water by the system, to the collection means.

In one embodiment of the invention, the system further includes contaminant gathering apparata for the collection of excess contaminant material into the collection means. Such contaminant gathering apparata would be used in collections when asphaltic or semi-hardened petroleum products could be present in the body of water or in any other exceptional condition.

The apron channeling means comprises an impenetrable apron member extending to a depth substantially below the bottom of the contaminant material and to a height substantially above the upper surface of the contaminant material. A penetrable lower screen member extends downwardly from a position beneath the lower surface of the contaminant for maintaining the apron channeling means in a generally upright position and for stabilizing the movements of the channeling means through the body of water when movement is initiated.

In an alternative embodiment, the apron channeling means comprises an integral plastic member impenetrable along the upper portion extending from below the bottom surface of the contaminant material to substantially above the upper surface of the contaminant material. Equivalent to the other embodiment, the integral apron has a lower surface which is substantially penetrable along the lower portion which extends downwardly from below the bottom surface of the contaminant material riding on the surface of the water.

The apron buoys which are used to maintain the apron channeling means afloat on the surface of the water, comprise a plurality of buoyant members which are attached to the apron channeling means along the outside periphery of the apron. Each of these buoys is substantially arcuately shaped to minimize drag in water when the movement is initiated and each of the buoys is attached to the channeling means in a secure, juxtaposed fashion by buoy attachment means.

Additional features may be utilized on the buoyant members including the use of rudder means for controlling the deployment of the apron channeling means about the contaminant material when movement is initiated. Additionally,, keel means on the bottom surface of the buoyant member, sail means to assist in the deployment of the buoys and the channeling aprons, and adjustable rudder means may be incorporated into the buoy means for controlling the direction of movement of the buoyant members and for in turn controlling the deployment of the apron channeling means in the body of water about the contaminant material.

As previously stated, the collection means includes adjustable scoop means for skimming the contaminant material from the surface of the body of water. This scoop means, in its preferred embodiment, comprises a substantially trapezoidal-shape, flanged scoop member, which is pivotally attached to the converging ends of the apron channeling means. The front of the scoop member is closely juxtaposed to these converging ends in order to effectuate complete and efficient skimming of all the contaminant material funneled into the scoop by the converging apron channeling means.

In the preferred embodiment, means for adjusting the scoop means comprises a substantially buoyant scoop roller means which is positioned beneath the scoop member. This scoop roller means is adjustable in a longitudinal direction beneath the scoop member to enable variations in skimming angle and immersion depth of the scoop member. Thus, for example, by adjusting the position of the scoop roller to and fro longitudinally beneath the scoop, the depth of skim and associated skim angle may be controlled as desired for oil slicks or contaminant spills of varying thickness. In alternative embodiments, the means for adjusting the scoop means comprises a substantially buoyant scoop pontoon which is positioned beneath the scoop member equivalently. The scoop pontoon is also adjustable in a longitudinal direction beneath the scoop member to enable variations in the skimming angle and immersion depth of the scoop member. Other variable buoyancy objects may be used to control the scoop angle and depth, such as a remote control variable ballast device.

In order to achieve a constant surface positioning of the apron channeling means relative to a possibly turbulent and rolling body of water, the preferred embodiment of the invention includes the utilization of a plurality of substantially shorter channeling segments which are each pivotally attached to one another respectively, in order to compensate in varying heights and depths of the body of water. By utilization of this plurality of channeling segments, the overall potentially extensive length of apron channeling material will be in substantial surface contact with the body of water in spite of swelling or rolling.

The contaminant separator means comprises a substantially cylindrical-shaped member, having a generally open top and bottom portion with scoop attachment means on its forward side for the pivotal attachment of said scoop means. Entry port means are fabricated closely adjacent scoop attachment means to accommodate the inward flow of water which is combined with the contaminant material delivered by the scoop means as it skims the contaminated body of water. Additionally, water buoyancy and stabilization means are utilized with the contaminant separator means for the purpose of maintaining the separator means in a desired position in the body of water, while at the same time stabilizing the movement of the separator therein. These buoyancy and stabilization means preferably comprise flotation buoy means which are affixed to the outer periphery of the cylindrical shaped member, as well as keel means which are located on the forward side of the cylindrical shaped member, substantially below the flotation buoy means for stabilizing the movement and position of the separator means in the body of water when movement is initiated.

It should be realized that the separator means separates the contaminant, such as oil, or petroleum, from the water upon which the contaminant is riding through the creation of a separation vortex formed as the funneled contaminant-water mixture is forced through the entry port means after being skimmed by the scoop means. This vortex literally forces the contaminant material upwardly while at the same time forcing the water downwardly, so as to effectively separate the two. Additional accessories may be utilized with the scoop means and the separator means under particular contaminant situations for the purpose of facilitating effective separation of the two. For example, the scoop means in one embodiment further comprises baffle means for forcibly directing the skimmed contaminant material and the water into a rotational spin within the separator when the movement of the system is initiated. Additionally, check valve means may be utilized in combination with the contaminant separator means, proximate to the entry port, to prevent the undesired inadvertent backflow of the contaminant material and water mixture from within the cylindrical member once the two are directed into the cylindrical member by the scoop means.

In one of the embodiments of the contaminant separator means, the cylindrical member has a plurality of water-release apertures towards the bottom rear side for releasing separated water more quickly, in addition to the water which is expelled out the bottom of the cylindrical member. Additionally, the cylindrical-shaped member comprising the contaminant separator, may be fabricated with an outwardly flanged reservoir at its top, for increasing storage capacity of the separated contaminant material as the separation vortex is created. Contaminant material thus stored from the separation process may then be safely and effectively pumped aboard more permanent storage means, such as a barge through, preferably, high capacity pumping circuitry initiating in the upper portion of the contaminant separator cylinder.

In an alternative embodiment, the cylindrical member has a substantially tapered bottom portion in order to create a substantial back pressure for improved separation of water from the contaminant material. Discharge of the water out the bottom portion of the separator cylinder may thus be accelerated.

In situations where an overwhelming presence of contaminant material exists, the rear side of the cylindrical member forming the contaminant separator has attached thereto, a secondary retention means connected by aperture to the top portion of the cylindrical member. This secondary retention means has additional secondary material transport means, such as a second pumping circuit, to accommodate a substantially high volume of contaminant material flowing into the secondary retention means from the cylindrical member so as to independently and more effectively remove the excess contaminant material from the system.

Depending upon the type of contaminant material being removed through skimming, oval shaped cylindrical members may be utilized with particular advantages. For example, a substantially oval cylindrical member, having narrow edges forming the front and rear side of the cylindrical member, may be utilized with the oval configuration promoting the formation of a separation vortex towards the rear side of the cylindrical member. Alternatively, the oval member may be utilized with the widest sides of the oval forming the front and rear sides of the cylindrical member respectively, for creating a rapid separation of contaminant material from the water. In such an embodiment, material transport means, having a pumping device and circuit, are operably attached to the rear side of the cylindrical member in order to directly transport the separated contaminant material from the separator means quickly and efficiently.

The cylindrical member may also be substantially cupped in shape to increase the storage capacity of the separator means for the contaminant material. Indeed, such a cup-shaped apparatus may, by itself, be used as a storage cylinder without skimming apparatus so as to prevent contaminant material from contaminating the body of water. Such a substantially cupped cylindrical-shaped member has an equivalent open top and bottom. The cup-shaped cylinders may be distributed around a disabled tanker, for example, to provide temporary storage means into which the tanker's oil may be stored before rupturing, to avoid contamination of the body of water. This cylindrical member is substantially buoyant and capable of receiving a supply of contaminant material without release into the body of water until the material may be removed from the storage cylinder to more permanent storage means.

As previously mentioned, contaminant-gathering apparatus may be utilized in combination with the collection and separation apparatus in order to assist in the removal and recovery of substantially bulky or chunky contaminant material, such as of the type which may be encountered when asphaltic crude oil mixes with substantially cold ocean water. In one embodiment, this contaminant-gathering apparatus comprises paddle wheel means which are operably and rotatably attached to the scoop means for effectively directing entry of the contaminant material and water into a contaminant separator means. These paddle wheel means include driver wheels on the outside of the scoop means which, in turn, drive scoop paddle means within the scoop as system movement is initiated. Alternatively, contaminant-gathering apparatus comprises conveyor removal means positioned in front of the scoop for preliminarily removing the substantially hard, bulky contaminant material to thereby prevent clogging of the collection means by such materials.

System movement and/or activation can be accomplished through several means. In one embodiment, water towing means are positioned at the open end of the apron channeling means to move the recovery system towards and about the contaminant material. The system activation means imparts flow to the body of water with its contaminant material, relative to the apron channeling means and, in turn, to the collection and separation means. Thus, the channeling means encompass the contaminant material to channel the material towards and into the collection means scoop and separator. Alternatively, the system activation means may rely upon the natural flow movement of the body of water itself. Such activation can be utilized for rivers and streams in which the system will be restrainably positioned relative to the body of water, for example, by being strung across from one bank of the river to the other bank. The natural flow of the river or other body of water channels and directs the contaminant material directly along the apron channeling means into the collection means and through the separator device.

In yet another embodiment, integrated propellant means are capable of pushing the system through the body of water to direct the contaminant material towards and into the collection means for subsequent separation and recovery.

DETAILED DESCRIPTION OF THE DRAWINGS

Figure 1:
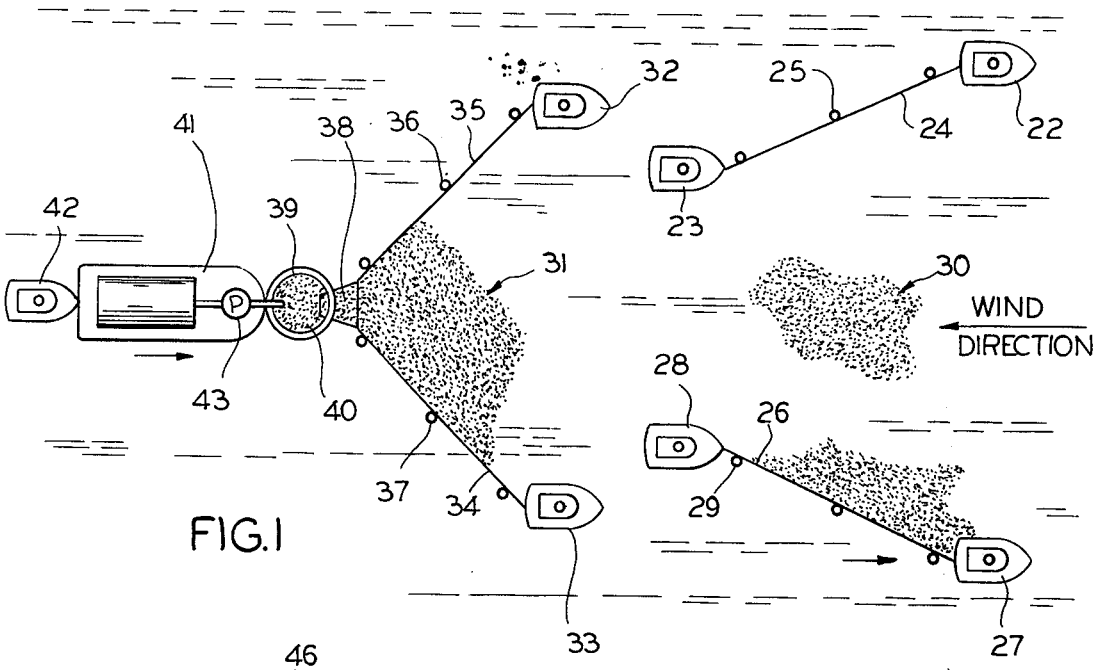
FIG. 1 of the drawings is a top schematic view of the system in operation as it is activated towards movement through towing means.

While this invention is susceptible of embodiment in many different forms, there is shown in the drawings and will herein be described, several specific embodiments, with the understanding that the present disclosure is to be considered as an exemplification of the principles of the invention, and is not intended to limit the invention to the embodiments illustrated.

FIG. 1 of the invention, the overall system, is shown being activated to remove and recover contaminant material, such as materials 30 and 31 from a body of water. Tow boats 32 and 33 are shown directing apron channeling means 34 and 35 afloat by buoys, such as buoys 36 and 37 around contaminant material 31. The movement into and about contaminant material 31 funnels or channels the contaminant material on the surface of water into scoop means 38 and subsequently into separation means 40 formed by separator cylinder 39. Material transport means 43 are shown operably connected to separator 40 for transfer of the contaminant material to permanent storage means 41, propelled by tow boat 42 at the same velocity as tow boats 32 and 33. Additionally, separate apron channeling means may be used to preliminarily funnel contaminant material into channeling aprons 34 and 35. For example, tow boats 22 and 23 are shown funneling contaminant material 30 through apron channeling means 24, kept afloat by buoy 25 in equivalent manner to the way in which tow boats 28 and 27 maneuver channeling means 26, supported by buoy 29.

Figure 2:
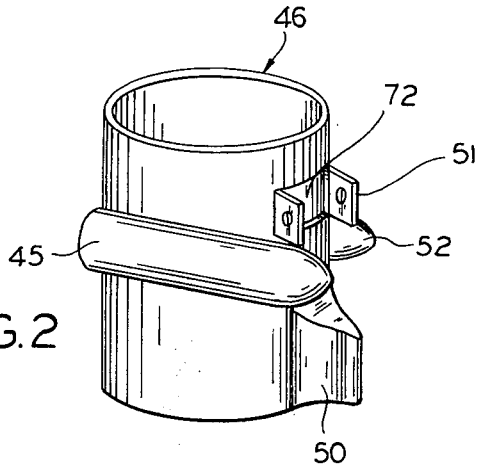
FIG. 2 of the invention is a side perspective view of the contaminant separator cylinder.

Separator means 46 is shown in FIG. 2 having scoop attachment means 51, entry port means 72 closely adjacent to the attachment means, buoyancy means 45 and 52 here comprising integrated pontoons, and stabilization means 50, here comprising an integrated keel assembly.

Figure 3:
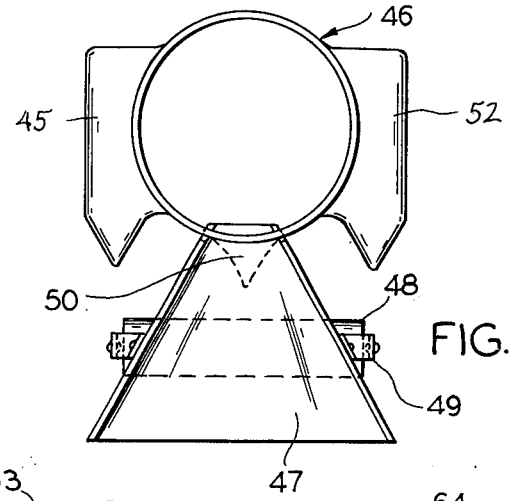
FIG. 3 is a top plan view of the separator means and collection means, showing, particularly, the apparatus feeding into the separator means.

Separator means 46 is also shown in FIG. 3 having buoyancy means 45 and 52 and keel 50, together with scoop 47, having buoyancy roller 48 attached by adjustable bracket 49.

Figure 4:
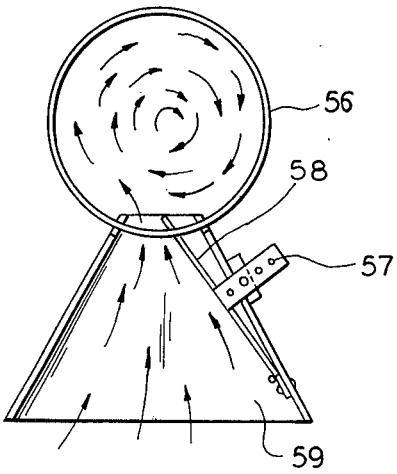
FIG. 4 is a top plan view showing, schematically, the creation of a vortex through baffle means.
Figure 5:
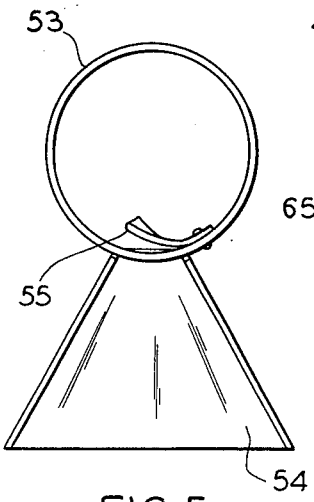
FIG. 5 is a top plan view of the collection and separator means showing utilization of check valve means therewith.

Through the utilization of the collection means scoop 59, as shown in FIG. 4, here utilized with baffle 58, connected by adjustment bracket 57, the creation of a vortex is promoted within cylinder 56. As shown in FIG. 5, scoop 54 and separator cylinder 53 may be utilized with a one-way check valve, such as gate 55, to prevent the inadvertent backflow of the contaminant and water once it enters through the entry port.

Figure 6:
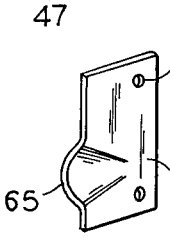
FIGS. 6 and 7 are side perspective views of two embodiments of check valve means, respectively.
Figure 7:
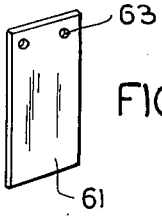

FIGS. 6 and 7, respectively, show two variations of the check valve means in which check valve 60 may be attached at the top of the entry port through apertures, such as aperture 64, and which has indentation 65 for facilitated opening. Check valve 61 is fabricated for attachment to the side of the entry port through attachment apertures, such as aperture 63.

Figure 8:
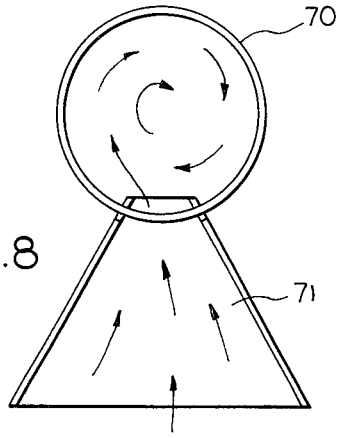
FIG. 8 is a top plan view of the separator and collection means, schematically showing the creation of the separation vortex.

It is important to realize that even without the utilization of baffling means to direct the inward flow of contaminant and water, there will still be created a vortex which forces the contaminant upwardly while discharging the clean water downwardly. FIG. 8 shows, schematically, the creation of such a vortex as a contaminant mixture, represented by arrows, passes over scoop 71 through the entry port, into and around separator cylinder 70.

Figure 9:
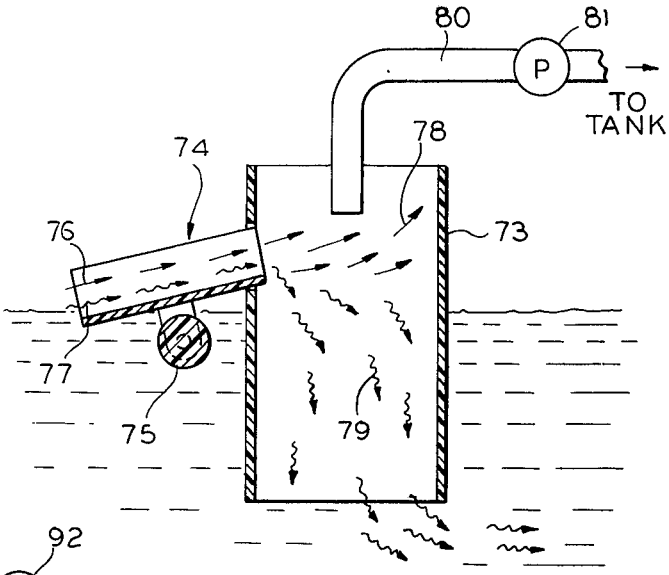
FIG. 9 is a cross-sectional side view of the collection and separator means schematically showing separation of the contaminant material from the body of water upon which it is riding.

Several specific embodiments of the separator apparatus which may be used for different weather, contaminants, and for use in different bodies of water, are shown in FIGS. 9 through 13. FIG. 9 shows the basic collection-separator combination in which scoop 74 leads directly into separator cylinder 73. As can be seen, scoop 74 is maintained at a particular skimming angle or immersed depth through adjustable buoyant roller 75 to draw up contaminant 76 with a portion of water, 77. As these two substances pass into the cylinder, a vortex is created, pushing contaminant 78 upwardly for removal by material transport circuit 80 and pump 81 to a more permanent storage area. Simultaneously, water particles 79 separated from contaminant 78 by creation of the separation vortex, are propelled downwardly and out the open bottom end of the cylinder.

Figure 10:
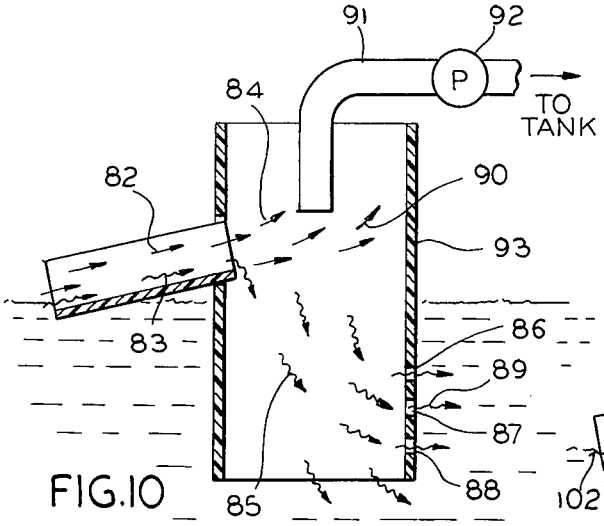
FIG. 10 is a cross-sectional side elevational view of the separator-collection means, having cylinder member means with additional water release apertures.

FIG. 10 shows a variation of the device shown in FIG. 9, in which contaminant molecules entering at 82 and 84 are pumped through circuit 91 and pump 92 to storage means 93 while separated water coming in at 83 are discharged downwardly with some of the water 85 leaving through the bottom of the cylinder and with quantities of other water, such as 89, leaving through exit apertures 86, 87 and 88. Container 90 is pumped from the storage means 93. Such an embodiment is utilized in more shallow water areas when a particularly heavy downward discharge is undesirable due to the creation of silt, and the like.

Figure 11:
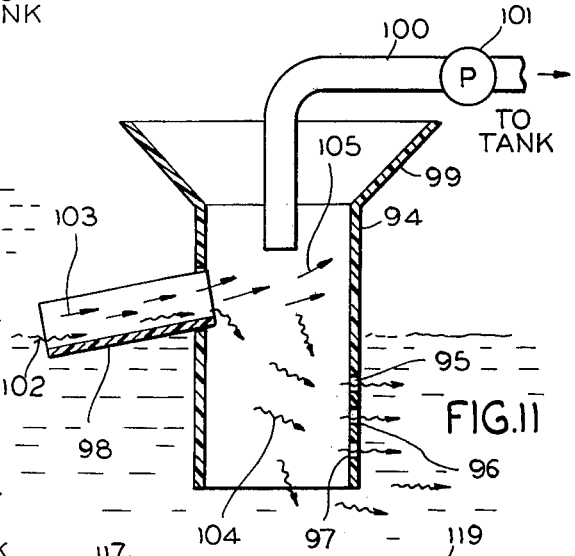
FIG. 11 is a cross-sectional side view of the collection and separator means, showing utilization of flanged contaminant reservoir means attached to the upper portion of the separator cylinder.

FIG. 11 shows an embodiment of the collection-separator means in which an outwardly flanged reservoir 99 is attached to the upper portion of separated cylinder 94. Incoming water 102 and contaminant 103 flow across scoop 98 into the cylinder 94. This provides for increased capacity of contaminant material 105 before it is necessary to activate material transport circuit 100 through pump 101. While in this particular embodiment release apertures 95, 96 and 97 are utilized to discharge separated water 104, it is clearly envisioned that the reservoir apparatus can be utilized with virtually any of these cylinder-separators described in this specification for the same purpose.

Figure 12:
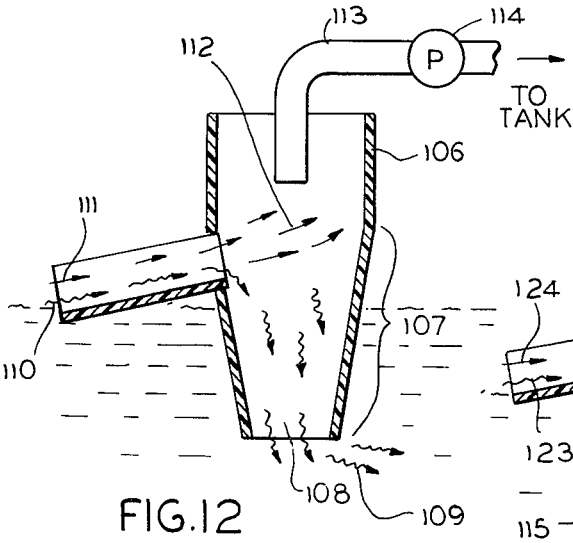
FIG. 12 is a side cross-sectional view of the separator-collector means, having a separator cylinder with a tapered bottom portion.

While the use of the external release apertures on the rear side of the cylinder minimizes the downward discharge flow, in other situations it may be desirable to maximize the discharge flow out the bottom of the container. Such an embodiment in which this may be accomplished is shown in FIG. 12 in which contaminant 111, riding on water 110, enters separator cylinder 106 with contaminant 112 being transported by circuit 113 and pump 114 to permanent storage. It should be noted that cylinder 106 is substantially tapered along portion 107 to increase the back pressure created by the vortex so as to more effectively raise the contaminant level for recovery while increasing the expelled discharge of water 109 out cylinder bottom 108.

Figure 13:
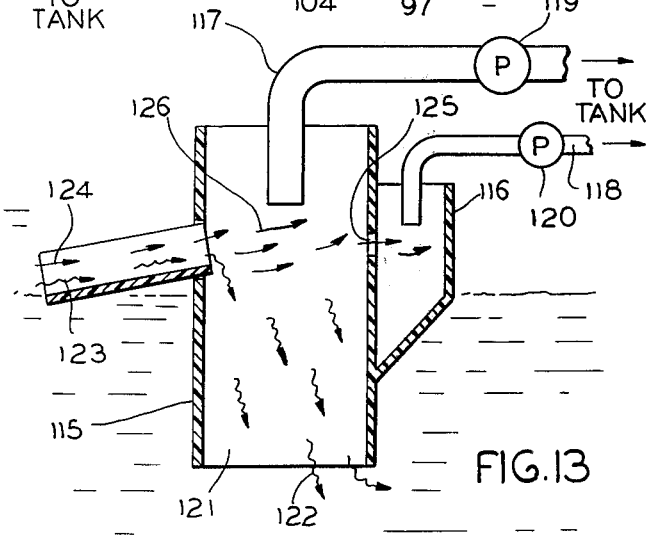
FIG. 13 is a side cross-sectional view of the separator-collection embodiment having secondary retention means and secondary material transport means.

In conditions when excessive contaminant may be present, or when material transport facilities are not as powerful as desired, it may be necessary to use secondary retention means to accommodate the amount of contaminant. Such an embodiment is shown by FIG. 13 in which oil entering at 124 on water 123, enters cylinder 115. Because of the excess contaminant, while some of the contaminant is removed by transport means 117 and pump 119, the remaining contaminant will emerge through aperture 125 into secondary retention means 116, having secondary transport means 118 utilizing pump 120, to remove the accumulated excess contaminant. In an equivalent manner to the other cylinders, water 122 will emerge through bottom 121 of separator-cylinder 115.

Figure 14:
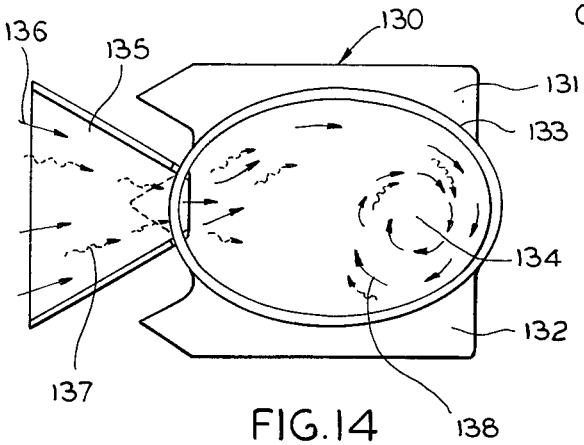
FIG. 14 is a top plan view of the oval-shaped separated cylinder of one embodiment.
Figure 15:
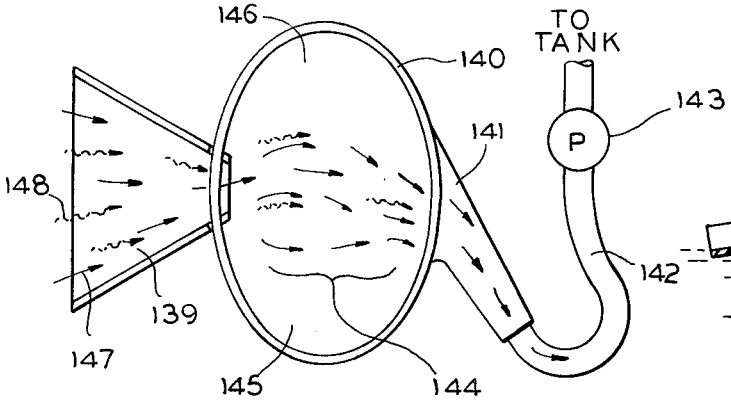
FIG. 15 is a top plan view of a second embodiment of the oval-shaped separator cylinder.

Oval separator 130 is shown in FIG. 14, having integrated buoyancy means 131 and 132 thereattached. Contaminant 136 and water 137, entering through skimming scoop 135 enter the oval-shaped cylinder 133 to create a vortex 134, at the rear end of the cylinder, sending the contaminant 138 upwardly for removal. In another embodiment of the oval separator, when the wide side of the oval comprises the front and rear of the separator, as shown in FIG. 15, contaminant 147 and water 148 enter through skimming scoop 139 into cylinder 140. Dead spaces, such as 145 and 146, are created and are filled almost entirely with water for quick evacuation of the contaminant 144 through material transport means 141 connected at the rear of oval cylinder 140. Material transport circuit 142, through pump 143, removes the contaminant to a permanent storage area.

Figure 16:
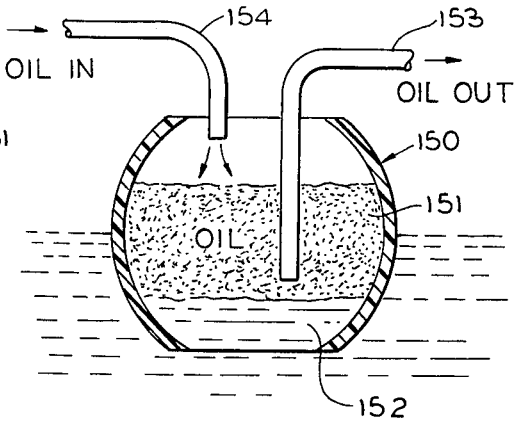
FIG. 16 is a side cross-sectional view of the cupped reservoir cylinder.
Figure 17:
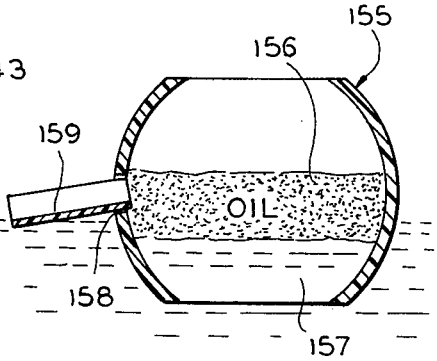
FIG. 17 is a side cross-sectional view of the cup-shaped separator cylinder with collection means attached.

Cupped storage container 150 is shown in FIG. 16 and comprises a storage facility on a body of water 152 through which oil 151 may be pumped away from a potentially ruptured grounded tanker, by circuit 154 and stored temporarily in cylinder 150, until such time that more permanent storage means can be obtained. At such time the oil is pumped out of storage cylinder 150 through circuit 153 to these more permanent storage means. These cup-shaped cylinders can also be modified to comprise a separator-cylinder through the addition of scoop means 159, and entry port 158. As shown in FIG. 17, cylinder 155 provides for substantially increased storage capacity for contaminants, such as oil 156, above a body of water 157.

Figure 18:
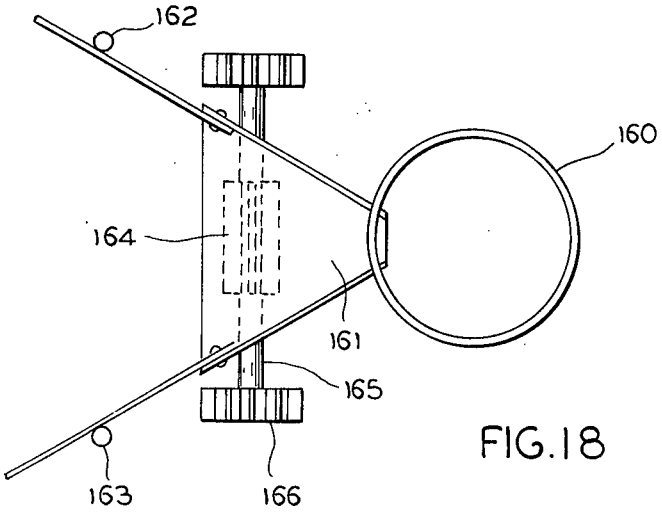
FIG. 18 is a top plan view of the collection means and separator cylinder, showing, particularly, utilization of paddle wheel means, with the collection means.
Figure 19:
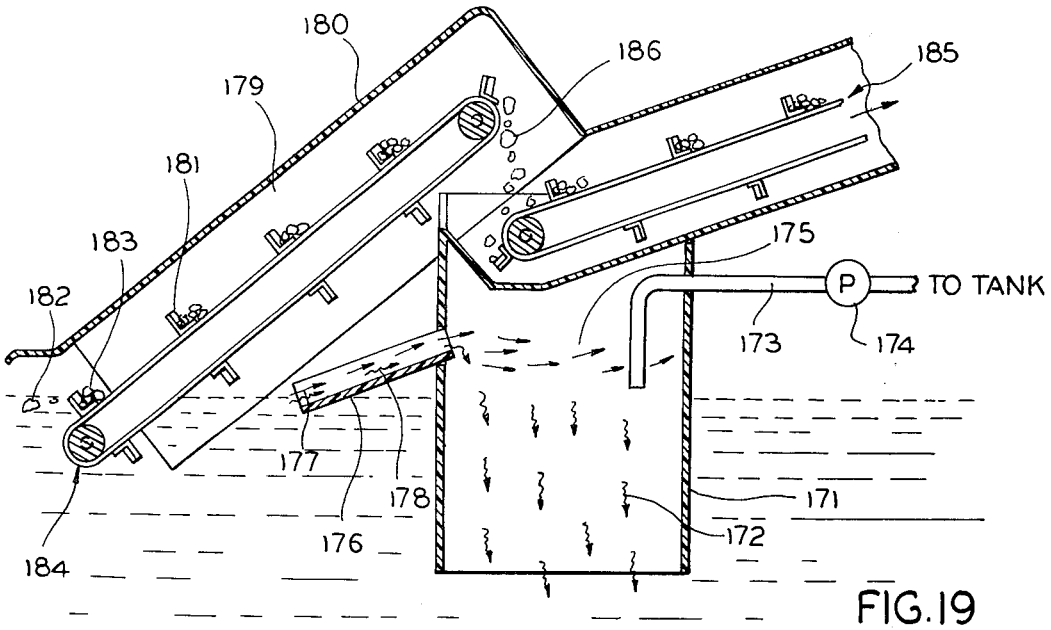
FIG. 19 is a side cross-sectional view of the collection-separator means, showing utilization of conveyor removal means.

FIG. 18 shows the utilization of the flow promoting paddle wheel 164 secured to a shaft 165 which is, powered by wheels such as 166, external to scoop 161. Buoyant members 162 and 163 are fixed to the apron channeling means. Inside the flanged edges of scoop 161 paddle 164 assists in the generation of flow through the entry aperture of cylinder 160. Conveyor means 180, such as that shown in FIG. 19 may also be used in combination with the collection-separator device. As can be seen, chunky particles, such as 182 are picked up by conveyor dogs 181 on a conveyor belt 184 disposed in a conveyor housing 179, brought into the collector and subsequently transferred by suitable equivalent conveyor means 185 to a permanent storage area. At the same time, non-chunky contaminants, such as 177, enter scoop 176 over water 178 and, as described earlier, are separated by vortex action within cylinder 171, with water 172 exiting at the bottom of the cylinder and contaminant exiting through the material transfer means 173, powered by pump 174.

Figure 20:
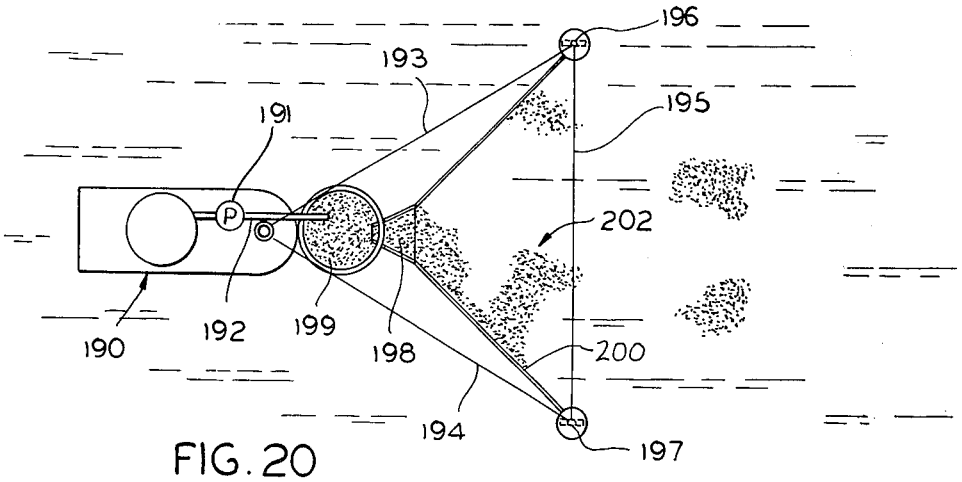
FIG. 20 is a top plan view of an integrated embodiment of the contaminant recovery system, utilizing propellant means for movement activation.
Figure 21:
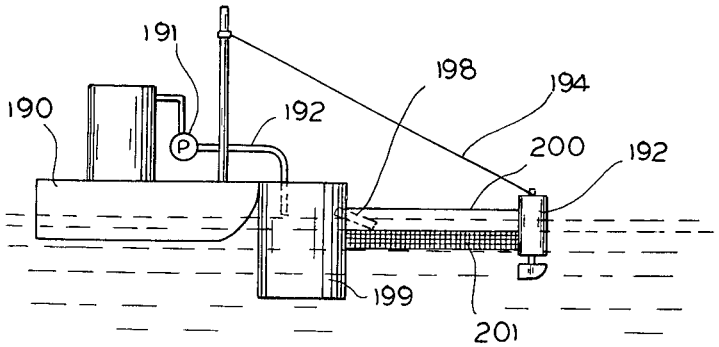
FIG. 21 is an elevational side view of the embodiment shown in FIG. 20, showing the integrated recovery system.

Yet another embodiment of the system activation means is shown in FIGS. 20 and 21 wherein a semi-rigid recovery system is pushed by propellant means 190, such as a powerboat. In an equivalent manner to the other embodiments, contaminant 202 is encompassed by apron channeling means 200, and is skimmed by scoop 198 before being directed into separator means 199. When the contaminant material is separated from the accompanying water in separator means 199, the contaminant alone can be directed by material transport means 192 into storage means on the boat through pump 191. Through the utilization of guys 193, 194 and 195, together with flotation means 196 and 197, the system is capable of operating without directional guidance at the open ends of the apron channeling means. As is clearly shown in FIG. 21, apron channeling means 200, in this embodiment, is shown utilizing lower screen portion 201 for stabilization and guidance of the apron channeling means.

The foregoing description and drawings merely explain and illustrate the invention, and the invention is not limited thereto, except insofar as the appended claims are so limited, as those skilled in the art who have the disclosure before them will be able to make modifications and variations therein without departing from the scope of the invention. For example, virtually any of the several rigid or inflationable materials could be used in the fabrication of the collection or separator means without departing from the scope of the invention.

What is claimed is:

1. A system for removing and recovering contaminant material from the surface of a body of water, comprising:

open-ended apron channeling means maintained afloat in said body of water by apron buoys, said apron channeling means being substantially impervious to said contaminant material;

contaminant collection means for collecting said contaminant material;

said apron channeling means attached to said contaminant collection means so as to converge thereto, said collection means including scoop means for skimming said contaminant material from the surface of said body of water as said contaminant material is directed to said collection means by said apron channeling means;

contaminant separator means operably attached to said collection means for separating said contaminant material from said water;

material transport means operably attached to said contaminant separator means for removing said separated contaminant material from said system, thereby enabling the recovery and reuse of said contaminant material as desired;

system activation means for the initiation of movement between said contaminated body of water relative to said channeling, collection and separator means to surround and direct said contaminated body of water to said collection means, said separator means comprising:

a substantially cylindrical-shaped member having a generally open top and bottom with scoop attachment means on a forward side for the pivotable attachment of said scoop means;

entry port means closely adjacent said scoop attachment means to accommodate the inward flow of water and contaminant material delivered by said scoop means as it skims said body of water;

water buoyancy and stabilization means for maintaining said separator means in a desired position in said body of water and for stabilizing the movement of said separator therein; and said cylindrical-shaped member of said contaminant separator having proximate to its top outwardly flanged reservoir means for increased storage capacity of said separated contaminant material.

2. The system for removing and recovering contaminant material from the surface of a body of water according to claim 1 in which the invention further comprises:

contaminant gathering apparata for collecting excess contaminant material into said collection means.

3. The system according to claim 2 in which said contaminant gathering apparata comprises:

paddle wheel means operably and rotatably attached to said scoop means for effectively directing entry of said contaminant material and water into said contaminant separator means, said paddle wheel means including driver wheels on the outside of said scoop means which turn scoop paddle means within said scoop means as said system movement is initiated.

4. The system according to claim 2 in which said contaminant gathering apparata comprises:

conveyor removal means positioned in front of said scoop means for preliminarily removing substantial, hard, bulky contaminant material and to prevent clogging of said collection means by such materials.

5. The system according to claim 1 in which said apron channeling means comprises:

an impenetrable upper apron member extending from below the bottom surface of said contaminant material on the surface of said body of water to a position substantially above the upper surface of said contaminant material; and a penetrable lower screen member extending downwardly from said upper apron member from a position beneath the lower surface of said contaminant material, for maintaining said apron channeling means in a generally upright position in said body of water while stabilizing the movement of said apron channeling means through said body of water.

6. The system according to claim 1 in which said apron channeling means comprises:

an integral apron member of plastic material which is impenetrable along an upper portion extending from below the bottom surface of said contaminant material to substantially above the upper surface of said contaminant material;

said integral apron member having a lower surface which is penetrable along a lower portion extending downwardly from below the bottom surface of said contaminant material on the surface of said body of water.

7. The system according to claim 1 in which said apron buoys comprise:

a plurality of buoyant members each of which is attached to said apron channeling means along the outside periphery of said apron channeling means, each of said buoyant members being arcuately shaped so as to minimize drag in said body of water when said movement is initiated and restrainably attached to said apron channeling means in juxtaposed fashion by buoy attachment means.

8. The system according to claim 7 in which one or more of said plurality of buoyant members includes rudder means for controlling the deployment of said apron channeling means about said contaminant material in said body of water.

9. The system according to claim 7 in which one or more of said plurality of buoyant members further comprises:

keel means on the bottom surface of said buoyant member;

sail means for facilitated movement of said buoyand members and, in turn, said channeling apron means attached thereto; and adjustable rudder means for controlling the direction of movement of said buoyant members and, in turn, said apron channeling means in said body of water.

10. The system according to claim 1 in which said scoop means for skimming said contaminant material from the surface of said body of water comprises:

a substantially trapezoidal-shaped flanged scoop member pivotally attached to the converging ends of the apron channeling means, the front of said scoop member closely juxtaposed to the converging ends of said apron channeling means.

11. The system according to claim 10 in which said scoop means has means for adjustment comprising:

substantially buoyant scoop roller means positioned beneath said scoop member, said scoop roller means being adjustable in a longitudinal direction beneath said scoop member thereby enabling variations in skimming angle and immersion depth of said scoop member relative to the position of said scoop roller means below said scoop member.

12. The system according to claim 10 in which said scoop means has means for adjustment comprising:

substantially buoyant scoop pontoon means positioned beneath said scoop member, said scoop pontoon means being adjustable in a longitudinal direction beneath said scoop member thereby enabling variations in skimming angle and immersion depth of said scoop member relative to the position of said scoop roller means below said scoop member.

13. The system according to claim 10 in which said scoop means further comprises:

baffle means for forcibly directing skimmed contaminant material and water into a rotational spin within said separator means when said movement of said system is initiated.

14. The system according to claim 1 in which said apron channeling means comprises:

a plurality of apron channeling segments pivotally attached to one another respectively thereby facilitating the constant surface positioning of said apron channeling means relative to a turbulent and rolling body of water.

15. The system according to claim 1 in which said water buoyancy and stabilization means comprises:

flotation buoy means affixed to the outer periphery of said cylindrical-shaped member; and keel means located on said forward side of said cylindrical-shaped member substantially below said flotation buoy means for stabilizing the movement and position of said contaminant separator means in said body of water when said movement is initiated.

16. The system according to claim 1 in which said contaminant separator means further comprises:

check valve means positioned proximate said entry port means to prevent the undesired, inadvertent backflow of contaminant material and water from within said cylindrical member by said scoop means.

17. The system according to claim 1 in which said contaminant separator means has a plurality of water release apertures towards said bottom rear side for releasing separated water quickly without unnecessary turbulence.

18. The system according to claim 1 in which said cylindrical member has a substantially tapered bottom portion in order to create a substantial back pressure for improve separation of said water from said contaminant material.

19. The system according to claim 1 in which the rear side of said cylindrical member has attached thereto secondary retention means operably connected to the top portion of said cylindrical member, said secondary retention means having secondary material transport means to accommodate substantially high volumes of contaminant material flowing into said secondary retention means from said cylindrical member, and to independently remove said excess contaminant material from said system.

20. The system according to claim 1 in which said cylindrical member is substantially oval in shape with the narrow sides of the oval providing the front and rear sides respectively of the cylindrical member, said oval configuration promoting the formation of a separation vortex towards the rear side of said cylindrical member.

21. The system according to claim 1 in which said cylindrical member is substantially oval-shaped with the wide sides of said oval providing the front and rear sides respectively of the cylindrical member, said material transport means being operably attached to said rear side of said cylindrical member in order to directly transport quickly separated contaminant material from said separator means.

22. The system according to claim 1 in which said cylindrical member is substantially cupped in shape to increase the storage capacity of said separator means for said contaminant material.

23. The system according to claim 1 in which said system activation means comprises:

water towing means positioned at the open ends of said apron channeling means, said system activation means imparting flow of said body of water relative to said collection means while said apron channeling means are directed into and about said contaminant material to channel said contaminant material towards and into said collection means.

24. The system according to claim 1 in which said system activation means comprises:

natural flow movement of the body of water itself, said system being restrainably positioned relative to said body of water, with said natural flow channeling and directing said contaminant material into said collection means.

25. The system according to claim 1 in which said system activation means comprises:

integrated propellant means capable of pushing said system through said body of water so as to create flow between said system and said body of water, thereby directing said contaminant material towards and into said collection means.

* * * * *